US005173070A

United States Patent [19]

Gould

[11] Patent Number: 5,173,070

[45] Date of Patent: Dec. 22, 1992

[54] PIZZA PIE PROTECTION DEVICE CONVERTIBLE TO CHILDS TOY

[76] Inventor: John C. Gould, 12 Mine Hill Rd., West Reading, Conn. 06896

[21] Appl. No.: 884,374

[22] Filed: May 18, 1992

[51] Int. Cl.[5] ..... A63H 1/00

[52] U.S. Cl. ..... 446/79; 446/71; 446/46; 446/236; 446/256; 273/424

[58] Field of Search ..... 446/34, 46, 69, 71, 446/76, 77, 79, 236, 255, 256, 257, 77, 80, 487; 273/424, 425; 206/495, 551, 599, 521, 591, 525

[56] References Cited

U.S. PATENT DOCUMENTS

| | | | |
|---|---|---|---|
| 1,404,132 | 1/1922 | Manes | 446/46 X |
| 1,683,643 | 9/1928 | Wittmaak | 273/425 |
| 3,185,480 | 5/1965 | Weyman et al. | 273/424 X |
| 3,964,745 | 6/1976 | Ogg | 273/424 X |
| 4,112,612 | 9/1978 | Woods | 273/425 X |
| 4,182,073 | 1/1980 | Tabet | 446/46 |
| 4,498,586 | 2/1985 | Vitale | 206/525 |
| 4,940,441 | 7/1990 | Novinsky | 273/424 X |
| 4,954,116 | 9/1990 | Rubino | 446/256 |

*Primary Examiner*—Robert A. Hafer
*Assistant Examiner*—Sam Rimell

[57] ABSTRACT

A shallow inverted circular saucer shaped first member has upper and lower exposed surfaces. A flat ring shaped second member has an inner periphery spaced from and surrounding the first member and also has upper and lower exposed surfaces. The first and second members are detachably interconnected. A plurality of vertical prongs cooperate with the members. One prong has an upper end secured to the center of the lower surface of the first member. The remaining vertical prongs have upper ends secured to the lower surface of the second member and are equidistantly spaced from each other.

6 Claims, 1 Drawing Sheet

PIZZA PIE PROTECTION DEVICE CONVERTIBLE TO CHILDS TOY

BACKGROUND OF THE INVENTION

One type of fast food product adapted to be produced in one location and to be delivered to customers at another location is the pizza pie. This pie is typically of circular shape and is stored and transported in a shallow rectangular box. The box is delivered to the location at which the pie is made in the form of a flat sheet having selctively disposed slots and lines of fold. Workers in the shop in which the pizza pies are produced are expected to fold and assemble these sheets into boxes during slack periods.

Since the pie is circular and the box is rectangular, once the pie is placed in the box and the box is moved, the pie may shift in position in the box, thus causing the pie to be distorted in shape and perhaps broken. In addition, when pressure is exerted upon the box, particularly in the region about the center, the pie can be crushed.

To avoid such undesirable consequences, it is known to use a pizza pie protection device in the form of a separate small plastic disposable member in the form of a horizontal disc having three or more vertical legs. This device is disposed in the box to engage the pie and to be held in place within the box to prevent the pie from shifting in position when the box is moved or being crushed when the top of the box is depressed.

In this known arrangement, after the device is in place and the pie is delivered for use, the device is removed and discarded.

The present invention is directed toward a new and improved plastic pizza pie protection device which either before use or after removal from the pie can be converted by manual manipulation into a childs toy, a finger flicking flying disc or spinnible top.

SUMMARY OF THE INVENTION

Accordingly, it is a primary object of the invention to provide a new and improved plastic pizza pie protection device which can be converted into a childs toy by manual manipulation.

Another object is to provide a new and improved plastic pizza pie protection device which is readily disposable either before or after conversion into a childs toy and which can be manufactured easily and inexpensively.

These and other objects and advantages of this invention will either be explained or will become apparent hereinafter.

In accordance with the principles of this invention, a plastic pizza pie protection device which can be converted into a childs toy utilizes a shallow inverted circular saucer shaped first member having upper and lower exposed surfaces. A flat ring shaped second member having an inner periphery spaced from and surrounding the first member and also has upper and lower exposed surfaces. Means detachably interconnects the first and second members.

The device also utilizes a plurality of vertical prongs. One prong has an upper end secured to the center of the lower surface of the first member. The remaining vertical prongs having upper ends secured to the lower surface of the second member and are equidistantly spaced from each other.

In use, the entire device is inserted into a pie in the manner previously described. However, once the device is removed, or even if it is not used in a pie, the first and second members and means can be manually manipulated until the two members are separated. The first member with its connected prong constitutes a childs toy, a finger flicking flying disc or spinnible top. Since the device is constituted entirely of plastic and too large to be swallowed, the toy is hazardless to small children.

DETAILED DESCRIPTION OF PREFERRED EMBODIMENT

Figure 1:
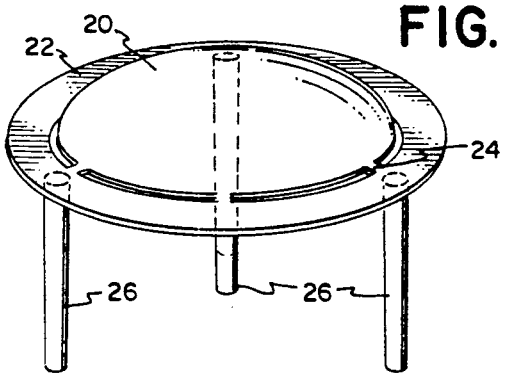
FIG. 1 is a perspective view of one embodiment of the device before use.
Figure 2:
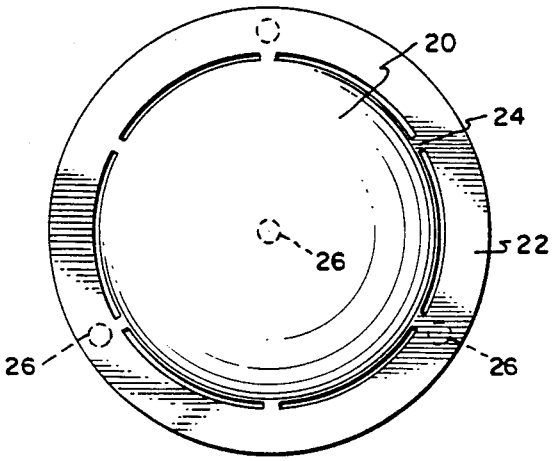
FIG. 2 is a top view of the embodiment of FIG. 1.
Figure 7:
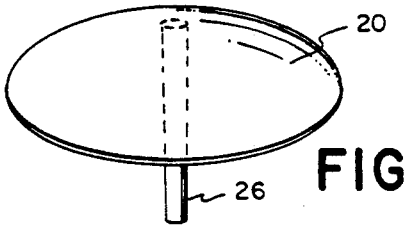
FIG. 7 is a perspective view of a child's toy, a finger flicking flying disc or spinnible top, as obtained by separation from either one of the embodiments shown in FIGS. 1–6.
Figure 4:
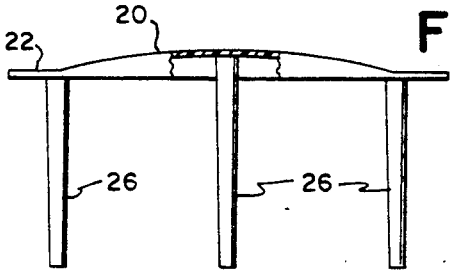
FIG. 4 is a side view of the embodiment of FIG. 1.
Figure 3:
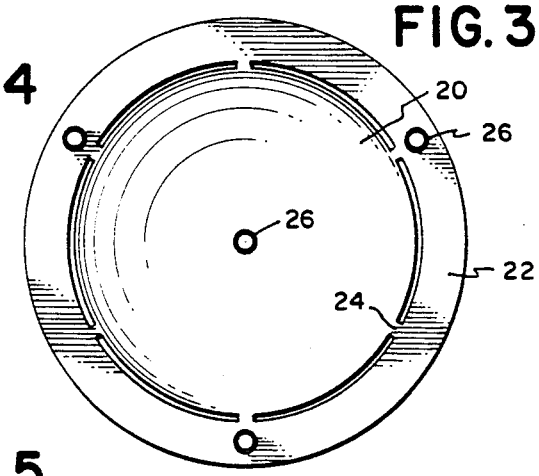
FIG. 3 is a bottom view of the embodiment of FIG. 1.

Referring now to FIGS. 1–4 and 7, a first plastic member 20 has the shape of a shallow inverted circular saucer with a typical diameter of 1.50 inches and a typical thickness of 0.10 inches. A second plastic member 22 has the shape of a flat ring with a typical outer diameter of about 1.80 inches, a typical inner diameter of about 1.60 inches and a thickness typically equal to that of the first member. The second member surrounds and is spaced from the first member. These two members are detachably secured together by means taking the form of a plurality of equidistantly spaced webs 24 which are substantially thinner than the members and integrally connect the inner periphery of the second member with the periphery of the first member.

A plurality, typically equal to four, of like vertical plastic prongs are utilized. These prongs are typically 1.0 inches long and about 0.15 inches in diameter. One prong 26 is secured at its upper end to the center of the lower surface of the first member and extends downwardly. The remaining prongs 26 are secured to the lower surface of the second member in equidistantly spaced positions midway between the inner and outer periphery of the second member and extend downwardly When the second member and first member and the webs are manually manipulated, the members separate. The first member 20 together with prong 24 constitutes a childs toy, a finger flicking flying disc or spinnible top.

Figure 5:
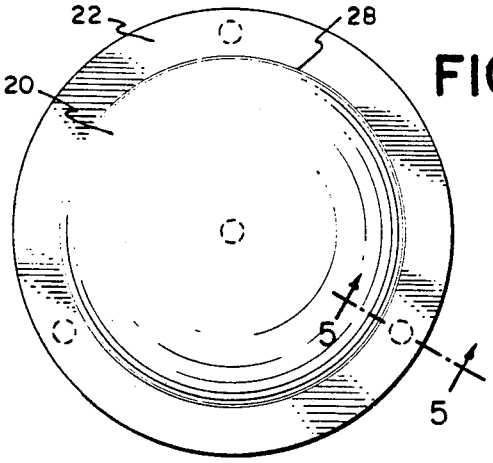
FIG. 5 is a top view of another embodiment of the device before use.
Figure 6:
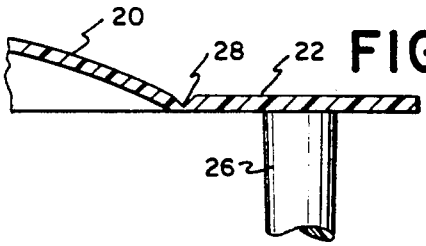
FIG. 6 is a detail view taken along line 5—5 in FIG. 5.

As shown in FIGS. 5 and 6, the webs can be replaced by a continuous ring 28. This ring is formed from a hollow plastic ring, such as polyethylene, which is filled with talc.

While the invention has been described with particular reference to the drawings and the preferred embodiment, the protection sought is to be limited only by the terms of the claims which follow.

What is claimed is:

1. A plastic pizza pie protection device which can be converted into a childs toy, a finger flicking flying disc or spinnible top, said device comprising:

a shallow inverted circular saucer shaped first member having upper and lower exposed surfaces;

a flat ring shaped second member having an inner periphery spaced from and surrounding the first member and also having upper and lower exposed surfaces;

means detachably interconnecting the first and second members; and a plurality of vertical prongs, one prong having an upper end secured to the center of the lower surface of the first member, the remaining vertical prongs having upper ends secured to the lower surface of the second member and being equidistantly spaced from each other.

2. The device of claim 1 wherein when the first and second members are disconnected from each other, the first member with its one prong constituting said toy.

3. The device of claim 2 wherein said plurality is equal to four.

4. The device of claim 3 wherein the means are spaced flat webs integral with and extending between the first and second members.

5. The device of claim 4 wherein each web is secured to the inner periphery of the second member and the periphery of the first member.

6. The device of claim 3 wherein the means is a continuous ring integral with and extending between the first and second members.

* * * * *